United States Patent [19]

Jacob

[11] Patent Number: 4,655,016

[45] Date of Patent: Apr. 7, 1987

[54] BUILDING CONSTRUCTION

[76] Inventor: David E. Jacob, 420 N. Orange, Mesa, Ariz. 85201

[21] Appl. No.: 776,657

[22] Filed: Sep. 16, 1985

[51] Int. Cl.[4] ..... E02D 1/92

[52] U.S. Cl. ..... 52/169.1; 52/251; 52/405

[58] Field of Search ..... 52/169.1, 94, 96, 251, 52/600, 405, 309.12, 612; 47/18, 32, 33, 39, 40, 68, 66, 82, 83

[56] References Cited

U.S. PATENT DOCUMENTS

| | | | |
|---|---|---|---|
| 1,084,967 | 1/1914 | Rosenleaf | 52/405 X |
| 3,675,368 | 7/1972 | Nustad | 47/66 |
| 4,018,021 | 4/1977 | Dow | 52/251 |
| 4,541,211 | 9/1985 | Garrett | 52/405 |

FOREIGN PATENT DOCUMENTS

| | | | |
|---|---|---|---|
| 2647521 | 4/1978 | Fed. Rep. of Germany | 52/405 |
| 573843 | 3/1924 | France | 47/44 |

*Primary Examiner*—William F. Pate, III

*Assistant Examiner*—Creighton Smith

*Attorney, Agent, or Firm*—James H. Phillips

[57] ABSTRACT

A building construction system is disclosed in which uniquely configured prefabricated concrete panels of great structural strength and high insulating value are employed. Each building panel, whether horizontal or vertical, is reinforced by transverse structural ties distributed along the panel length. Each structural tie includes a central portion of a reinforcing bar which has respective ends extending into concrete outer panel layers. Voids between the concrete outer layers may be filled with insulation such as polystyrene. A uniquely configured parapet is also disclosed. The parapet, which may extend to any length including the entire circumference of a building, comprises a channel which is generally parallel to the building edge and which is adapted to hold living plants including bushes, flowers and the like as well as small trees in enlarged channel regions. Thus, the utility of a building roof as a decorative and private living space is enhanced.

5 Claims, 8 Drawing Figures

BUILDING CONSTRUCTION

FIELD OF THE INVENTION

This invention relates to the building construction arts and, more particularly, to building construction incorporating prefabricated insulated concrete wall and roof panels.

BACKGROUND OF THE INVENTION

In modern building construction practice, buildings with exteriors exhibiting masonry or stucco finishes have been constructed in accordance with several alternate techniques. As an example of stucco construction, the basic structure may comprise cinder blocks emplaced one at a time in the traditional manual fashion, the complete wall thereafter being finished on the outside by successive layers of plywood, paper, screen and stucco and on the inside as desired, often wallboard covered with a textured layer. Finally, the exterior must be painted and an appropriate finish applied to the interior. Similarly, a wood frame construction may be employed in place of the cinder blocks with the exterior and interior surfaces finished somewhat as noted above. Typically, insulation is also incorporated in the interstices between the inner and outer layers.

Many buildings, both commercial and residential (particularly in the southwest) incorporate flat roofs. The flat roofs have typically required a wooden or metal framework structure over which, by way of example, successive layers of plywood, tar paper, sealant, and rock are emplaced. The interior ceilings may be finished in a manner similar to the walls, and insulation is typically provided in the framework interstices.

The traditional construction methods are costly and time consuming. As previously mentioned, for the wall structures, cinder blocks must be manually laid one by one, and the wooden framework must be assembled, either on site or in a prefabrication plant, merely in order to reach the stage of construction at which attention can be directed to completing the outer and inner surfaces. A problem particularly associated with flat roof construction is that the load bearing capacity is somewhat limited such that vertical columns or walls must be provided on fairly close spacings in order to insure the presence of sufficient load bearing capacity to provide long term support for the roof's self weight as well as machinery, such as air conditioning systems and the like, which may be situated on the roof and also, in some structures, to permit routine access to the roof as an extention of the living environment.

Those skilled in the construction arts will therefore appreciate the desirability of realizing preassembled wall and/or flat roof panels which are relatively lightweight, are very strong, are very well insulated and, in the case of roof panels, are able to span relatively long horizontal distances without the provision of intermediate vertical load bearing structures. Further, it will be additionally appreciated by those skilled in the art that it would be highly desirable to provide such panels which require very little or no further finishing to the exterior and/or interior surfaces to complete the structure.

OBJECTS OF THE INVENTION

It is therefore a broad object of my invention to provide an improved building construction system.

It is another object of my invention to provide an improved building construction system which admits of a substantial degree of prefabrication.

It is a more specific object of my invention to provide a building construction system in which wall and roof panels of unique design are employed.

It is a still further object of my invention to provide improved building construction wall and roof panels comprising insulated concrete means.

It is yet another specific object of my invention to provide such insulated concrete panels which are relatively lightweight and are very strong.

In another aspect, it is a specific object of my invention to provide roof panels of insulated concrete which, due to their unique construction, have high load bearing capacity across relatively long spans to obviate or minimize the necessity for providing intermediate vertical load bearing structures, thereby obtaining the facility for achieving large, unbroken spaces in the usable area of a building.

In yet another specific aspect, it is an object of my invention to provide such building panels which incorporate unique positive integrated panel linking structure facilitating their abutting aligned or angular assembly to adjacent panels in such a manner that a very strong joint is obtained.

SUMMARY OF THE INVENTION

Briefly, these and other object of my invention are achieved by providing a building assembly panel prefabricated to include generally parallel concrete outer layers encompassing high quality insulation in a sandwich-like manner. The concrete outer layers are provided with conventional reinforcing and/or prestressing means and are further strengthened by the provision, at intervals intermediate the length of each panel, a transverse, specially reinforced, concrete structural tie. In certain embodiments, the panels further include, at respective panel ends, an angular, relieved troughlike area running the length of the panel end. Periodically spaced along the panel end are projections of reinforcing bar disposed in a hairpin configuration, the closed end extending beyond the panel edge, and the open end legs extending, respectively, into the concrete outer layers. When adjacent panels are butted together, the closed ends of the reinforcing bar hairpins overlap to define a path for receiving a reinforcing bar extending generally parallel to the abutting panel edges and central within the void comprising the juxtaposed relieved portions of the respective panel edges. A strong final joint is obtained by filling the void with grout, and access for this step may be obtained by employing slightly asymmetrical upper and lower concrete outer layers whereby slightly shorter layers are aligned to define an access duct to the void.

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

DETAILED DESCRIPTION OF THE INVENTION

Figures 1, 2:
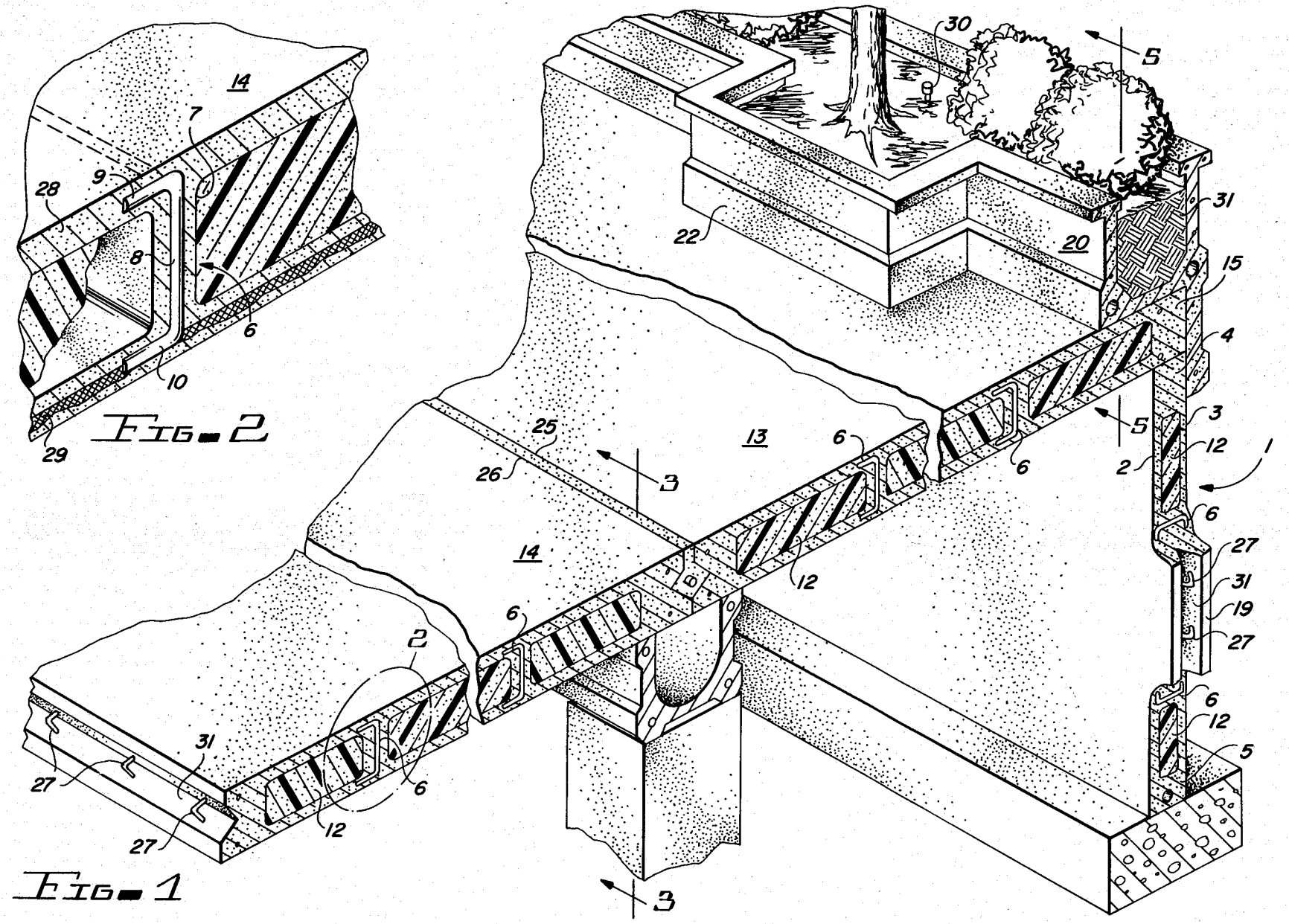
FIG. 1 is a partially cutaway three-quarter view illustrating the construction of a building in accordance with the present invention in an exemplary region at which a vertical outside wall panel and a horizontal roof panel meet and which incorporates a special parapet also supported at the junction.
FIG. 2 is a fragmentary cross-sectional view taken in the region 2 of FIG. 1 and illustrates a structural feature which obtains enhanced rigidity and strength of structural panels.

Referring now to FIG. 1, certain common features of my wall and roof panels which contribute to their energy efficiency, lightweight, and strength will be pointed out. By way of initial example, consider vertical outside wall panel generally indicated at 1. Wall panel 1 comprises outside concrete layers 2, 3 terminating at concrete ends 4, 5. Intermediate along the length of wall panel 1 are a plurality of structural panel ties 6. The structural tie feature will be discussed more fully below when the corresponding structure in a roof panel is described.

Encompassed by the concrete layers 2, 3, by edge 19 (which is shown mostly cutaway in FIG. 1) and by the ends 4, 5 and structural ties 6 are cavities containing layers of insulation 12 which may be, by way of example, rigid expanded polystyrene. The insulation layers 12 may be disposed throughout the height of the wall panel 1 between the panel ends and structural ties and between successive structural ties. In order to further increase the load bearing strength of the wall panel 1, conventional vertically oriented reinforcing iron and/or prestressing cables, not shown in FIG. 1, are preferably included within the concrete layers 2, 3.

Supported on and extending at right angles from the top of wall panel 1 is a first roof panel 13. A second roof panel 14 immediately adjacent roof panel 13 extends the area of the roof, and as many roof panels as are necessary for obtaining the total roof area may be employed in a similar cooperative manner. Roof panels 13, 14, like the wall panel 1, include a plurality of structural ties 6. Also in common with the wall panel 1, insulated layers 12 are provided in the roof panel. It will be observed in FIG. 1 that the abutting edges 25, 26 between the first roof panel 13 and second roof panel 14 are especially configured to obtain very rigid joints. These adjoining structures include hairpin reinforcing bars 27 which are best shown at the open end of roof panel 14. The reinforcing bars 27 reach into and beyond a generally V-shaped trough 31 which extends along the full width of the edge of each panel incorporating the joint system, and their cooperation will be discussed in detail below in conjunction with FIGS. 3 and 4. It will be observed that the edge 19 of wall panel 1 is similarly configured.

Optionally, a roof parapet, indicated generally at 20, may be supported atop the junction of the wall panel 1 and the roof panel 13 and thus runs generally parallel to the building edge. Parapet 20, as can be seen in FIG. 1, is of unique configuration in that it comprises an upwardly opening, generally U-shaped channel 21 containing plant-supporting soil. The parapet 20 may extend to any length desired, including the total circumference of the building roof, and may include positions, such as at 22, in which the channel width is increased. As shown in FIG. 1, parapet 20 serves as a region in which plants can be introduced and maintained for privacy and pleasure. Thus, bushes, flowers and the like and even small trees disposed at the enlarged position 22 may be planted in the uniquely configured parapet. This parapet configuration is especially desirable for incorporation into buildings in which the roof itself is deemed an important region of the living space, such as commonly practiced in metropolitan areas. It nonetheless can be enjoyed with any flat roofed building to which ready access to the roof is provided. In order to improve the maintainability of plants in the parapet 20, and suitable watering means 30 may be contained within the channel 21.

Figure 5:
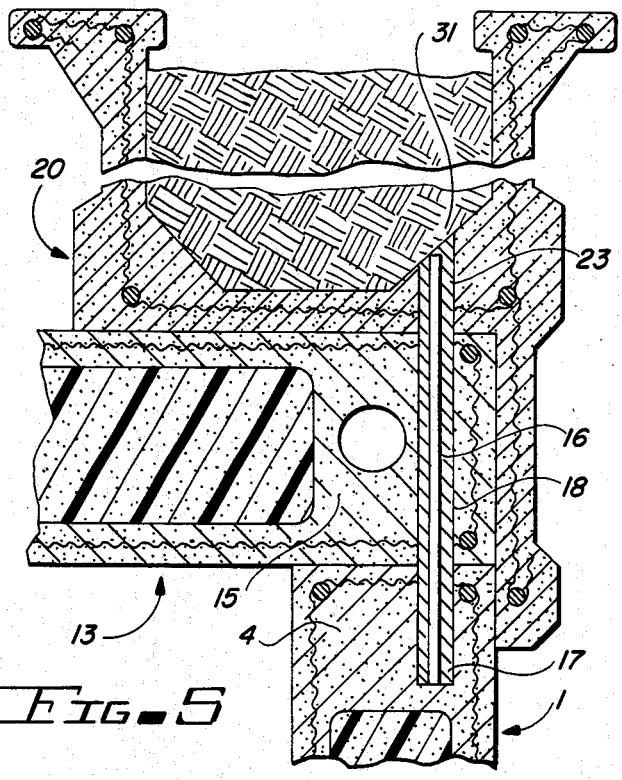
FIG. 5 is a more detailed view of the junction of the roof and wall panels and the special parapet which are also illustrated in FIG. 1.

Referring briefly to FIG. 5, a first end 15 of the roof panel 13 is directly supported by wall panel 1. Wall panel 1, roof panel 13 and parapet 20 are, in this configuration, securely juxtaposed by a series of rigid shear rods 16 which may typically comprise one inch steel and be positioned four or five feet between centers. The shear rods 16 are keyed into vertically aligned openings 17, 18, 23 which are provided, respectively, in the end region 15 of the roof panel 13, in the end 4 at the top of wall panel 1 and in the prarpet 20 toward the outer edge. Once the keyed components are in place, the aligned channels 17, 18, 23 containing the shear rods 16 may be filled with grout.

As previously mentioned, the strength of both wall panels and roof panels is substantially enhanced, both as to compression and tension, by the provision of structural ties 6 distributed along the panel length. As shown in FIG. 2, each structural tie 6 comprises a transverse concrete link 7 in which is embedded the connecting portion 8 between the legs 9, 10 of a U-shaped piece of reinforcing bar. In the example shown, the legs 9, 10 of the U-shaped reinforcing bar 11 are embedded within the respective concrete layers 28, 29 of the roof panel 14 such that the structural tie 6 serves to greatly increase the rigidity and strength of the panel. Of particular effect in roof and floor panels, the incorporation of the structural ties makes possible the use of horizontal panels having relatively lengthy spans without vertical support, thus increasing the available free space below the panels.

Figure 3:
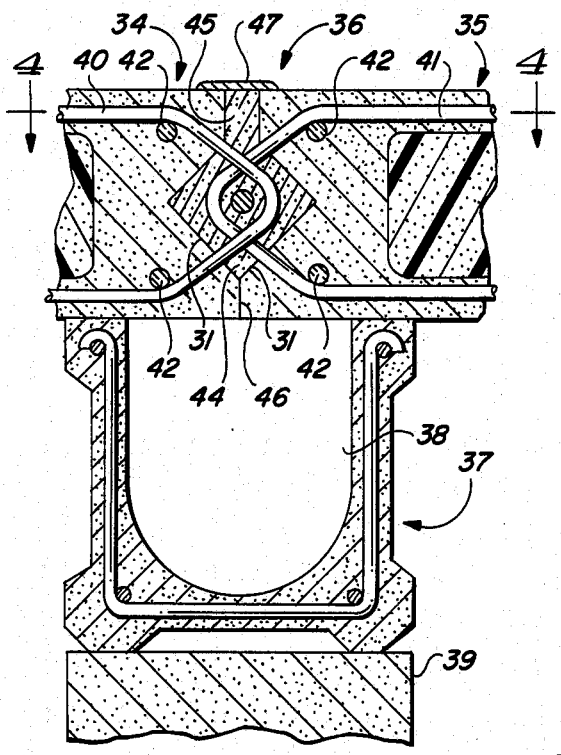
FIG. 3 is a fragmentary cross-sectional view taken along the lines 3—3 of FIG. 1 and illustrates one preferred configuration for a keyed joint between adjacent panels whereby a very strong joint is obtained.
Figure 4:
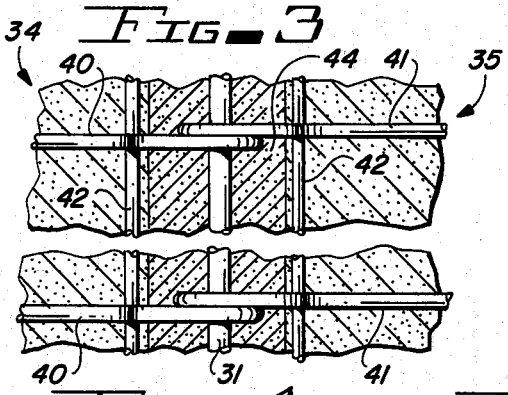
FIG. 4 is a fragmentary cross-sectional top view taken along the lines 4—4 of FIG. 3.

Consider now the detailed view of an exemplary roof panel joint depicted in FIGS. 3 and 4 in which it will be seen that abutting panels 34, 35 are joined in the region 36 which is afforded significant local strength by transverse reinforcing bars 42. The panels 34, 35 are supported beneath the joint region 36 by reinforced transverse concrete beam 37 within which duct 38 may be provided to carry conditioned air within the structure interior and/or serve as passages for electrical or other utility means. The transverse concrete beam 37 may be supported at intervals by pillars such as the pillar 39.

It will be understood that when the panels 34 and 35 are juxtaposed, their respective hairpin reinforcing bars 40, 41 slightly overlap in the central region of a diamond-shaped cavity 44 formed from the facing V-shaped troughs 31 of the panels 34, 35, thereby providing a path through which a transverse key reinforcing bar 43 may be threaded across the full width of the joint. Once the transverse key reinforcing bar 43 is in place, the entire diamond shaped cavity 44 is filled with grout through the access passage 45 which is thereafter sealed off by a cap 46. Thus, a very rigid joint of great strength is effected between the panels 34, 35. Passageway 45 preferably extends across the full joint width and may readily be obtained by making the top portions of the panels slightly shorter than the bottom portions which therefore engage at the region 46 and leave the passageway 45 for receiving the grout to complete the key. If desirable for a specific installation, passageway 46 may then be capped off as at 47.

Referring briefly to FIG. 1 at the wall panel edge, it will be appreciated that adjacent wall panels can be similarly joined. However, if there is access from the wall top to the vertical cavity formed by the meeting of the V-shaped troughs in the wall panel edges, the grout may simply be introduced at that point and allowed to fill the cavity under the influence of gravity.

Figure 6:
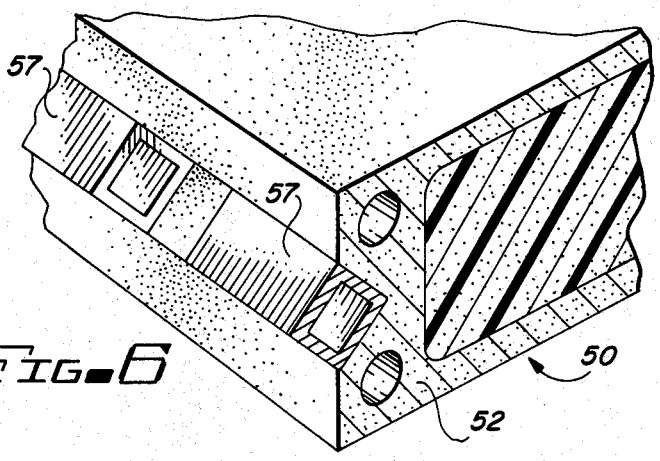
FIGS. 6 and 7 are, respectively, fragmentary three-quarters and fragmentary side views which illustrate a modification to the panel structure illustrated in FIG. 1 by which the incorporation of expansion absorbing capability at the joint between panels is achieved.
Figure 7:
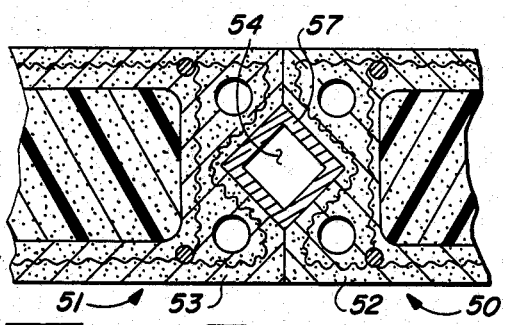

For some panel applications, it is desirable to have expansion absorbing capability in the joint between adjacent panels. FIGS. 6 and 7 illustrate a variation of the basic concrete panel which enjoys this feature. Thus, panels 50 and 51 incorporate the structural advantages previously discussed including structural ties which encompass reinforcing bars and prestress cables, none shown in detail in FIGS. 6 and 7. The cavities defined by panel ends and/or structural ties, as may be the case, may either be filled with insulation as previously described or, as may be an advantage in the case of a floor panel, left void. The ends 52, 53 of the panels 50, 51 terminate in V-shaped troughs 55, 56 to define a diamond shaped cavity 54. In order to provide the capability for absorbing expansion between adjacent panels, a series of square steel tube sections 57 may be placed at intervals along the joint as best shown in FIG. 6.

Figure 8:
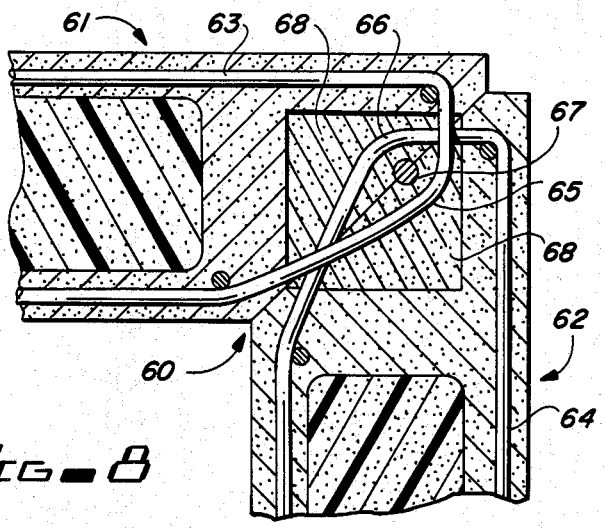
FIG. 8 illustrates a keyed corner construction of one preferred configuration for effecting the junction of outside vertical panels to roof panels.

An especially strong configuration for joining a pair of vertical outside panels at a right angle is illustrated in FIG. 8. In the joint region 60, both the first panel 61 and the second panel 62 terminate at a forty-five degree angle to obtain the ninety degree joint. For this configuration, the respective hairpin reinforcing bars 63, 64 for the panels 61, 62 have asymmetrical loops 65, 66 which, when the panel ends are juxtaposed, overlap to provide a path through which a transverse reinforcing bar 67 may be threaded for the full width of a joint. Thereafter, as previously described, grout 68 is pumped, poured or otherwise introduced into the joint cavity to complete the key and provide a right angle joint of great rigidity and strength.

The several panels described, and other equivalent panels comprehended by the invention, may be fabricated using any suitable process. It is very desirable that the process be one of precision in order to permit ready assembly of the panels into structures comprising many such panels without the need for undue allowance for alignment errors and the like. One suitable process is to fabricate the panels in a controlled environment utilizing steel forms to insure quality and accuracy. For efficiency, both sides of the panel may be finished as the panel is fabricated, such that architectural design and color can be determined during the fabrication process.

While the principles of the invention have now been made clear in illustrative embodiments, there will be immediately obvious to those skilled in the art many modifications of structure, arrangements, proportions, the elements, materials, and components, used in the practice of the invention which are particularly adapted for a specific environment and operating requirements without departing from those principles.

I claim:

1. A structural building panel comprising:

A. first and second spaced apart and generally parallel concrete outer layers;

B. first and second concrete ends extending between said first and second concrete outer layers;

C. first and second concrete edges extending between said first and second concrete outer layers;

D. at least one transverse structural tie, said structural tie comprising:

1. a transverse concrete structural link extending between said first and second concrete outer layers and disposed generally normal with respect thereto;

2. said transverse concrete structural link extending between said first and second edges and disposed generally normal with respect thereto;

3. at least one reinforcing bar having a central section and first and second end sections;

i. said central section included within said concrete structural link and extending from said first concrete outer layer to said second concrete outer layer;

ii. said first end section extending at a right angle with respect to said central section and disposed within said first concrete outer layer; and iii. said second end section extending at a right angle with respect to said central section and disposed within said second concrete outer layer; and E. said first and second concrete outer layers, said first and second concrete ends and said concrete structural cooperatively defining at least two cavities.

2. The structural building panel of claim 1 in which said cavities are filled with insulation.

3. A structural building system comprising:

A. at least first and second structural building panels;

1. each said building panel comprising first and second spaced apart and generally parallel concrete outer layers;

2. each said building panel having at least one joint end characterized by a trough extending across the width thereof;

3. at least one hairpin-configured reinforcing bar incorporated in each joint end, each hairpin-configured reinforcing bar comprising a closed loop end and an open end defined by first and second legs;

a. said loop end extending into said trough;

b. said first leg being disposed within said first concrete outer layer;

c. said second leg being disposed within said second concrete outer layer;

B. said first and second structural building panels being disposed in joint-end-abutting juxtaposition whereby their respective troughs define a joint channel and said respective closed loop ends of said hairpin-configured reinforcing bars comprising each joint end overlap in said joint channel to define a key-bar-receiving path;

C. a key reinforcing bar extending along said key-bar-receiving path; and

D. grout filling said joint channel.

4. The structural building system of claim 3 in which each said structural building panel further comprises:

A. first and second ends extending between said first and second concrete outer layers;

B. first and second edges extending between said first and second concrete outer layers;

C. at least one transverse structural tie;

1. said transverse structural tie extending between said first and second concrete outer layers and disposed generally normal with respect thereto;

2. said transverse structural tie extending between said first and second edges and disposed generally normal with respect thereto; and D. said first and second concrete outer layers, said first and second concrete ends, and said concrete structural cooperative tie defining at least two cavities;

E. at least one reinforcing bar having a central section and first and second end sections;

1. said central section including within said structural tie and extending from said first concrete outer layer to said second concrete outer layer;

2. said first end section extending at a right angle with respect to said central section and disposed within said first concrete outer layer; and 3. said second end section extending at a right angle with respect to said central section and disposed within said second concrete outer layer.

5. The structural building system of claim 4 in which said cavities are filled with insulation.

* * * * *